US009427636B1

(12) United States Patent
Ivanova et al.

(10) Patent No.: US 9,427,636 B1
(45) Date of Patent: Aug. 30, 2016

(54) GOLF CLUB HEAD MANUFACTURING METHOD

(71) Applicant: CALLAWAY GOLF COMPANY, Carlsbad, CA (US)

(72) Inventors: Irina Ivanova, San Marcos, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/846,506

(22) Filed: Sep. 4, 2015

(51) Int. Cl.
*A63B 53/04* (2015.01)

(52) U.S. Cl.
CPC ..... *A63B 53/047* (2013.01); *A63B 53/04* (2013.01); *A63B 2053/0479* (2013.01)

(58) Field of Classification Search
CPC .. A63B 53/0047; A63B 53/04; A63B 53/00; Y10T 29/00; B22D 31/00
See application file for complete search history.

(56) References Cited

U.S. PATENT DOCUMENTS

| | | | | |
|---|---|---|---|---|
| 5,669,825 | A * | 9/1997 | Shira | A63B 53/04 473/324 |
| 2004/0171434 | A1* | 9/2004 | Radcliffe | A63B 53/04 473/324 |
| 2010/0331108 | A1* | 12/2010 | Rick | A63B 53/047 473/349 |
| 2012/0304451 | A1* | 12/2012 | Park | A63B 53/04 29/527.2 |
| 2013/0137532 | A1* | 5/2013 | Deshmukh | B21K 17/00 473/349 |

* cited by examiner

*Primary Examiner* — John E Simms, Jr.
(74) *Attorney, Agent, or Firm* — Rebecca Hanovice; Michael Catania; Sonia Lari

(57) ABSTRACT

Methods of bifurcating the material properties of golf club heads, and wedges in particular, are disclosed herein. The methods of the present invention preserve the bendability and feel of certain parts of the club heads, such as hosel regions, while selectively hardening and increasing the durability of other features, such as scorelines and texturing on the face.

7 Claims, 5 Drawing Sheets

GOLF CLUB HEAD MANUFACTURING METHOD

CROSS REFERENCES TO RELATED APPLICATIONS

Statement Regarding Federally Sponsored Research or Development

Not Applicable

BACKGROUND OF THE INVENTION

1. Field of the Invention

The present invention relates to a method of manufacturing a golf club head with improved face and hosel material properties. In particular, the inventive method bifurcates the material properties of face and hosel using a single hardening process so that the face is hard enough to maintain excellent spin via improved durability of the performance-related features and textures, and the hosel is soft enough to allow for loft and lie adjustment via bending processes.

2. Description of the Related Art

Wedges typically are made from softer steel materials than other irons to optimize feel during play and to allow the loft and lie of the club to be adjusted by bending the hosel. Wedges also preferably have playability characteristics such as increased spin off the face, which is mostly influenced by features like scorelines, micro-features proximate the scorelines, and textured contact surfaces. Unfortunately, the softer the material of the wedge, the easier it is for these features to wear out or deform from use. Wedge manufacturers have tried to improve the durability of face features without reducing hosel bendability by, for example, localized induction hardening or case hardening the hitting area of the face, and induction annealing the bendable region of the hosel. All of these methods require that any equipment used be localized and fine tuned for face regions of the club head, and the heating processes associated with these methods typically can only be performed on individual parts or a small batch of parts at any one time. These approaches may also require custom designed heating elements that may not be reusable for small variations in head geometry.

Therefore, there is a need for a simple, scalable method of hardening wedge faces and improving scoreline durability without reducing the bendability of their hosels or otherwise changing the clubs' bending profiles.

BRIEF SUMMARY OF THE INVENTION

The methods of the present invention improve the process of bifurcating face and hosel material properties, while optimizing the heat treatment process or targeting only the critical regions of the face with a precisely controlled process. Some of these methods simplify the hardening process by heating large batches of parts and then mechanically processing them via grinding, machining, or other such processes to achieve bifurcation. For example, the full surface of a wedge can be hardened, e.g., by case hardening, to a target depth, and then specially added material stock or masking can be removed from the bendable region of the hosel to expose soft substrate. Other methods reduce the need for extra equipment and processes by using laser hardening to selectively improve the durability of critical areas of the face. In some embodiments, the method includes laser-hardening scoreline EDs, scoreline walls, and/or micro-features on the face. In other embodiments, the method includes laser hardening the whole hitting region of the face. Laser hardening is desirable because it is accurate and controllable, and does not require the creation or use of custom equipment to treat selected regions of the face.

One aspect of the present invention is a wedge comprising an upper hosel region and a face having a first, high hardness value, and a bending region with a second, lower hardness value.

Another aspect of the present invention is a method comprising the steps of manufacturing a golf club head comprising a top portion, a sole portion, a rear portion, a face, a hosel, and a build up of excess material around at least a part of the hosel, processing the face, hardening the head, removing the excess material from the hosel, and finishing the head, wherein the excess material is integrally formed with the hosel, and wherein the step of removing the excess material from the hosel occurs after the step of hardening the head. In some embodiments, the step of hardening the head may comprise at least one process selected from the group consisting of carburization, nitriding, carbonitriding, nitrocarburization, quenching, flame hardening, and tempering.

In a further embodiment, the step of hardening the head may comprise the process of carburization, and the excess material may have a thickness of at least 0.050 inch. In another embodiment, the step of hardening the head may comprise the process of nitriding, and the excess material may have a thickness of at least 0.020 inch. In yet another embodiment, the step of hardening the head may comprise the process of carbonitriding, and the excess material may have a thickness of at least 0.050 inch. In some embodiments, the step of processing the face may comprise adding a plurality of scorelines to the face, and adding secondary texture to the face proximate the scorelines. In other embodiments, the golf club head may be a wedge-type golf club head, and the step of manufacturing the golf club head may comprise a casting process.

Yet another aspect of the present invention is a method comprising the steps of manufacturing from a first material a wedge-type golf club head comprising a top portion, a sole portion, a rear portion, a face, and a hosel, masking a portion of the hosel with a second material different from the first material, processing the face, hardening the head, removing the second material from the hosel, and finishing the head, wherein the step of removing the second material from the hosel occurs after the step of hardening the head. In some embodiments, the first material may have a first thermal conductivity value, the second material may have a second thermal conductivity value, and the second thermal conductivity value may be lower than the first thermal conductivity value. In a further embodiment, the first material may be steel and the second material may be clay. In other embodiments, the second material may be a chemical barrier or a physical barrier, and the step of hardening the head may comprise at least one process selected from the group consisting of carburization, nitriding, carbonitriding, nitrocarburization, quenching, flame hardening, and tempering.

Another aspect of the present invention is a method comprising manufacturing a golf club head comprising a top portion, a sole portion, a rear portion, a face, and hosel, laser hardening at least a portion of the face, and finishing the head, wherein the face comprises a plurality of scorelines, and wherein each of the scorelines comprises an ED region and a plurality of side walls. In some embodiments, the step of laser hardening at least a portion of the face may comprise laser hardening at least a portion of the scorelines, while in other embodiments, the step of laser hardening at least a portion of the face may comprise applying laser beams at an angle with respect to at least one of the plurality of side walls. In an alternative embodiment, the face may comprise a plurality of micro-features, and the step of laser hardening at least a portion of the face may comprise laser hardening at least one of the plurality of micro-features.

Yet another aspect of the present invention is a wedge-type golf club head comprising a body comprising a top portion, a sole portion, a rear portion, a face, and a hosel, wherein the body is integrally formed from a single metal material, wherein the hosel comprises a bending region, wherein the face comprises a striking surface having a plurality of scorelines and a textured region proximate the scorelines, and wherein the bending region is more ductile than the striking surface. In a further embodiment, the bending region may be more ductile than the rest of the body, and the metal material may be a carbon steel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to methods of selectively hardening some features of golf club heads, and wedges in particular, while preserving the bendability of other features.

Figure 1:
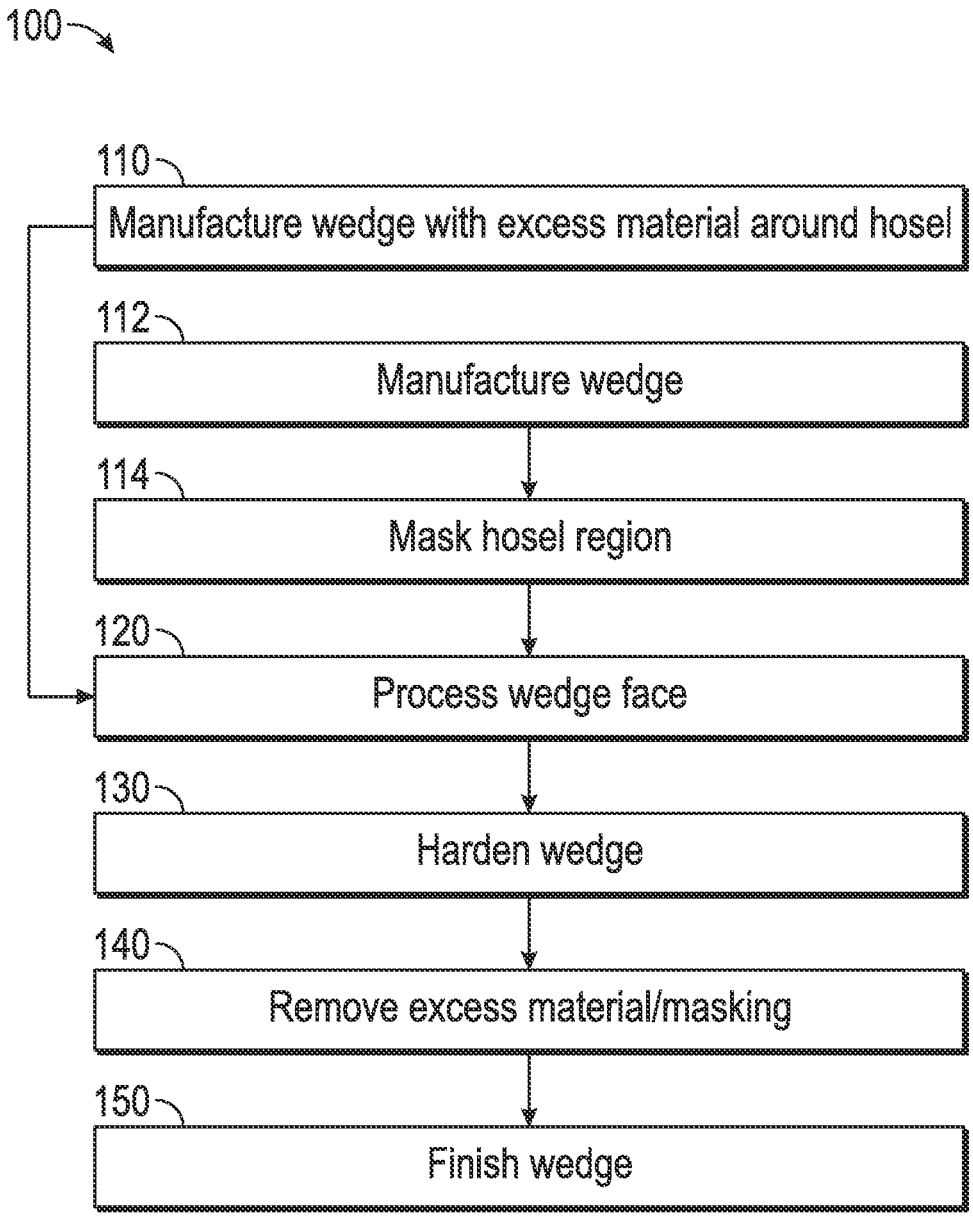
FIG. 1 is a flow chart of a preferred method of the present invention.
Figure 2:
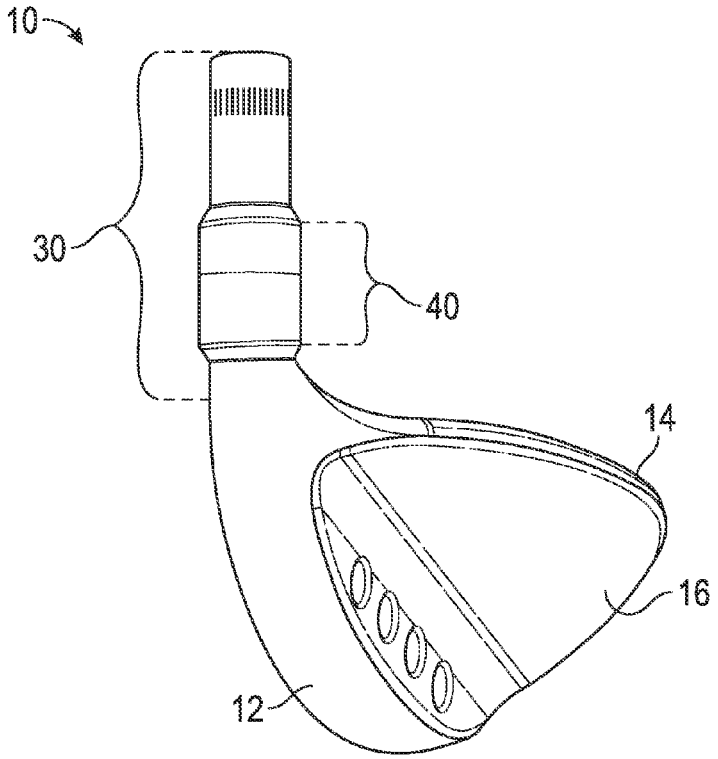
FIG. 2 is a side elevational view of a wedge of the present invention having excess material in its hosel region.
Figure 3:
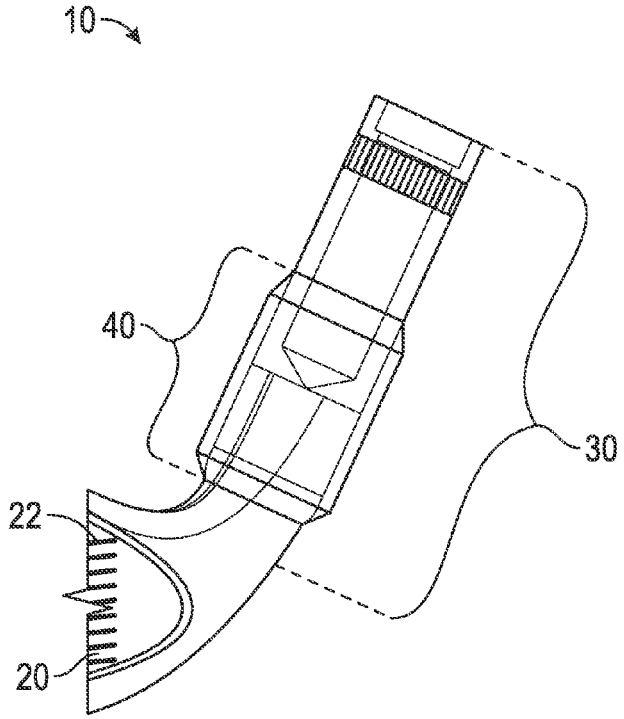
FIG. 3 is a front, plan, partially transparent view of the wedge shown in FIG. 2.

FIGS. 1-6 illustrate a first, preferred method of the present invention. In the first step, shown in FIGS. 1-3, a wedge head 10 comprising a sole region 12, top region 14, rear region 16, face 20, and hosel region 30 is manufactured from a metal alloy material, preferably stainless or carbon steel. In one version of the first step, the head 10 is integrally formed, forged, cast, or otherwise created with excess material 40 in the area of the head 10 where the material should remain soft to permit bending 110. The hosel region 30 preferably deforms more readily than the rest of the head 10 during bending, so as shown in FIGS. 2-3, the excess material 40 preferably is disposed around at least 20% of the hosel region 30, and may be disposed around up to 100% of the hosel region 30. This excess material 40 may be located elsewhere on the head 10 if the manufacturer deems it necessary for feel or other playability characteristics, such as the rear region 16 behind the face 20, where a softer, less strong, more flexible zone can change the primary mode of vibration and thus change sound and feel of the wedge head 10, but no matter where it is placed, it must remain on the head 10 until after heat treatment is completed.

Figure 6:
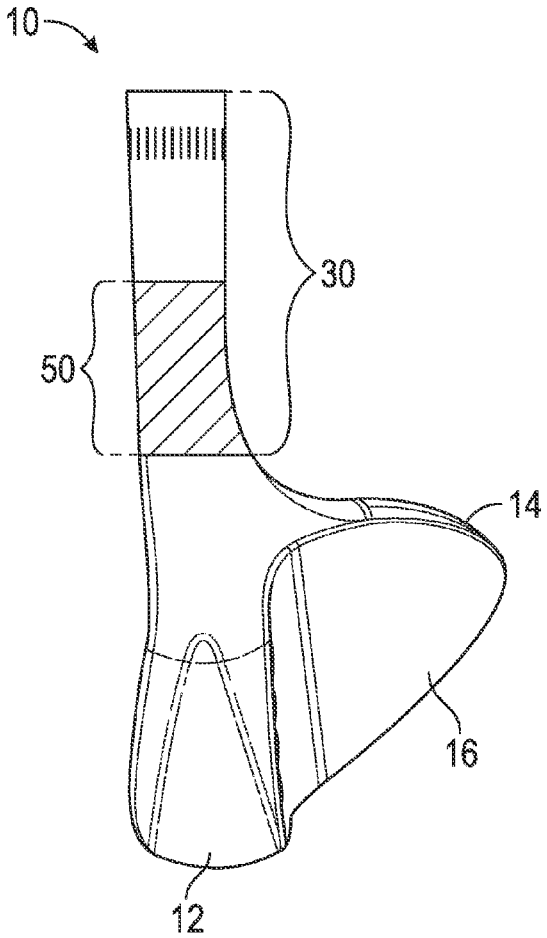
FIG. 6 is a side elevational view of a wedge having a masking agent in its hosel region.

In an alternative version of the first step, shown in FIGS. 1 and 6, the head 10 is created 112 without excess material 40 on the hosel region 30, and a masking agent 50 is then applied to the area that should remain soft for bending 114, in this case the hosel region 30. The masking agent 50 preferably is a chemical layer, e.g., paint, but may be a physical barrier, e.g., tape or a material with low thermal conductivity, such as clay.

Once the head 10 is manufactured and the hosel region 30 is protected as described above, the face 20 is processed 120 either to rough polish, fine polish, or textured prior to plating. This step 120 may also include the addition of scorelines 22 via stamping, machining, lasering, or other means known to a person skilled in the art, if scorelines 22 are not simultaneously added to the face 20 when the head 10 is initially formed, forged, cast, or machined.

The head 10 is then subjected to a hardening treatment 130. The type of hardening treatment selected determines the minimum thickness of the excess material 40 placed around the hosel region 30 (or other regions that the manufacturer wishes to remain soft), as each hardening treatment affects the head 10 at different depths. In general, the thickness of the excess material 40 around the hosel region 30 should greater than the depth of the hardening effect so that the hosel does not crack or crease during the bending process. For example, if the head 10 is hardened by carburization, which is most effective on lower carbon steels, the thickness of the excess material 40 should be greater than approximately 0.030-0.050 inch. If the head 10 is hardened by nitriding, a form of case hardening, then the thickness of the excess material 40 should be greater than approximately 0.020 inch. Nitriding can be performed either on raw (untreated) heads 10, or on heads 10 that have already been hardened by quenching or tempering for a greater effect. If the head 10 is hardened by carbonitriding or nitrocarburization, then the excess material 40 should be greater than 0.050 inch. If the head 10 is hardened by quenching, which generally is applied to higher carbon steels and is usually followed by tempering, the depth of the hardening effect depends on the rate of cooling during quenching, and may vary. The desired depth and length of the build-up or masked region can be determined either by testing or by FEA, which then can inform the required minimum thickness of the excess material 40.

Figure 4:
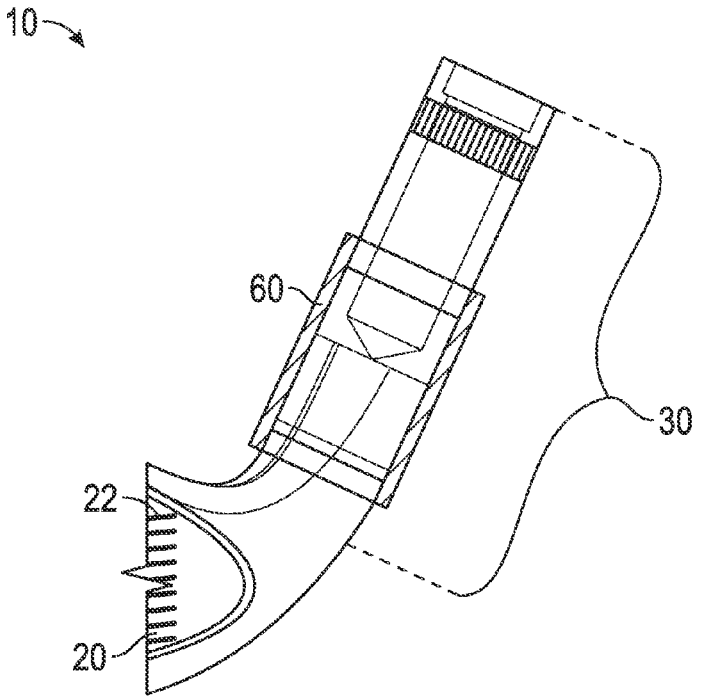
FIG. 4 is a front, plan, partially transparent view of the wedge shown in FIG. 2 with a tool removing the excess material.
Figure 5:
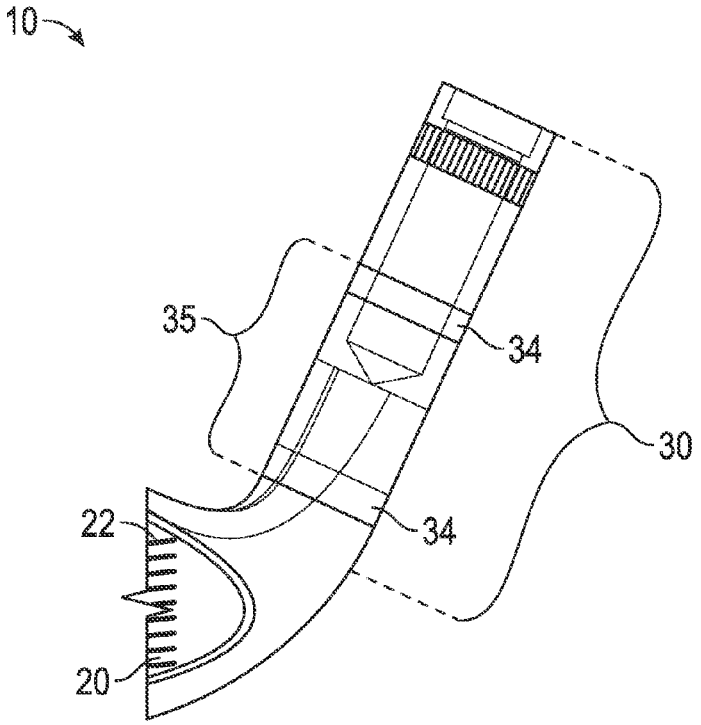
FIG. 5 is a front, plan, partially transparent view of the wedge shown in FIG. 2 without the excess material.

Once the hardening step 130 is completed, the excess material 40 or masking agent 50 is removed with a tool 60 via a mechanical process 140, illustrated in FIG. 4, and the head 10 can be finished 150 by any process desired by the manufacturer. When the head 10 is finished, the area 35 in the hosel region 30 originally covered by the excess material 40 or masking agent 50 (also known as the substrate) blends smoothly with the rest of the head 10, as shown in FIG. 5, but is much softer, and thus more ductile, than the rest of the head 10. In an alternative embodiment, one or more small grooves can be left at the transition region 34 between the area 35 originally covered by the excess material 40 or masking agent 50 and the rest of the head 10 to indicate to users the location of the softer, bendable region.

Figure 7:
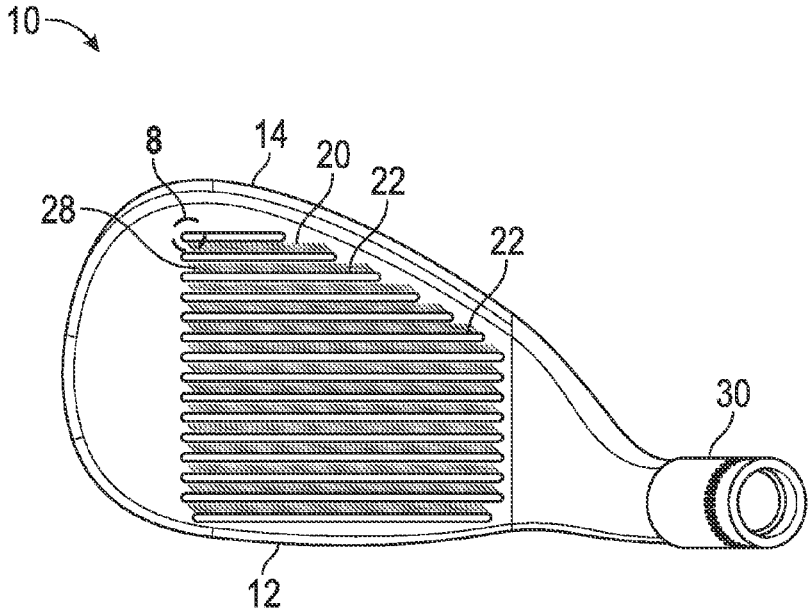
FIG. 7 is a front elevational view of another wedge of the present invention.
Figure 8:
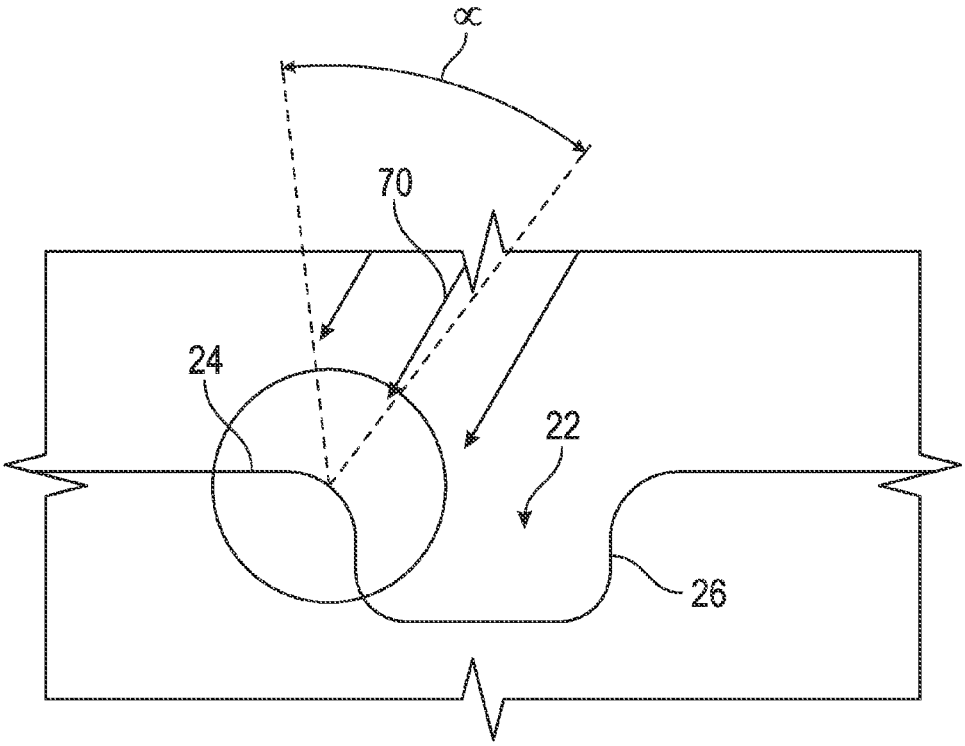
FIG. 8 is a cross-sectional view of the circled area in FIG. 7 undergoing laser processing.
Figure 9:
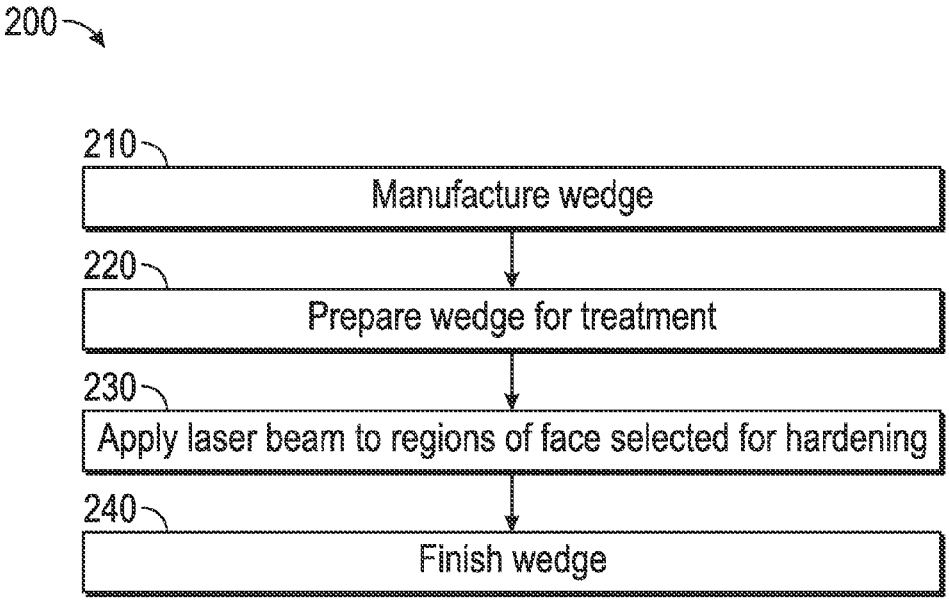
FIG. 9 is a flow chart of an alternative method of the present invention.

In another method 200 of the present invention, illustrated in FIGS. 7-9, the wedge head 10 first is manufactured 210 as desired by a manufacturer (e.g., by casting, forging, forming, or the like), and then is prepared 220 for treatment to selectively improve the durability of critical areas of the face 20. This treatment involves the user of laser beams 70 to harden, for example, the ED region 24 of the scorelines 22, scoreline walls 26, or microfeatures/texturing 28 on the face 20. As shown in FIG. 8, during this laser treatment 230, the laser follows the walls 26 and/or ED regions 24 of the scorelines 22, preferably at an angle α determined by the geometry of the region being treated to cover various features of the scorelines 22. Depending on the beam 70 width, several passes across the target may be necessary. Once the features have been hardened to the satisfaction of the manufacturer, the head 10 is finished 240 via any process desired by the manufacturer.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method comprising the steps of:

manufacturing a golf club head comprising a top portion, a sole portion, a rear portion, a face, a hosel, and a build up of excess material around at least a part of the hosel;

processing the face;

hardening the head;

removing the excess material from the hosel; and finishing the head, wherein the excess material is integrally formed with the hosel, and wherein the step of removing the excess material from the hosel occurs after the step of hardening the head.

2. The method of claim 1, wherein the step of hardening the head comprises at least one process selected from the group consisting of carburization, nitriding, carbonitriding, nitrocarburization, quenching, flame hardening, and tempering.

3. The method of claim 2, wherein the step of hardening the head comprises the process of carburization, and wherein the excess material has a thickness of at least 0.050 inch.

4. The method of claim 2, wherein the step of hardening the head comprises the process of nitriding, and wherein the excess material has a thickness of at least 0.020 inch.

5. The method of claim 2, wherein the step of hardening the head comprises the process of carbonitriding, and wherein the excess material has a thickness of at least 0.050 inch.

6. The method of claim 1, wherein the step of processing the face comprises adding a plurality of scorelines to the face, and adding secondary texture to the face proximate the scorelines.

7. The method of claim 1, wherein the golf club head is a wedge-type golf club head, and wherein the step of manufacturing the golf club head comprises a casting process.

* * * * *